US005761599A

United States Patent [19]

Weng et al.

[11] Patent Number: 5,761,599

[45] Date of Patent: Jun. 2, 1998

[54] IMAGE FORMING APPARATUS WITH MULTIFUNCTION OPENING

[75] Inventors: Han-Chang Weng; Chien-Yi Wu; Cheng-Hsien Lu; Chui-Chien Chiu, all of Taoyuan, Taiwan

[73] Assignee: Acer Peripherals, Inc., Taiwan

[21] Appl. No.: 837,130

[22] Filed: Apr. 14, 1997

[51] Int. Cl.[6] ..... G03G 15/00

[52] U.S. Cl. ..... 399/367; 358/496; 358/497; 399/371

[58] Field of Search ..... 399/16, 17, 365, 399/367, 371, 368; 355/75, 70; 358/474, 494, 496, 497, 498

[56] References Cited

U.S. PATENT DOCUMENTS 4,561,765 12/1985 Masuda ..... 399/367

FOREIGN PATENT DOCUMENTS 1-37161 2/1989 Japan .

*Primary Examiner*—Arthur T. Grimley
*Assistant Examiner*—Quana Grainger

[57] ABSTRACT

An image forming apparatus including a document-inlet, a multifunction opening, a document-outlet, a first document path and a second document path, is provided. The multifunction opening selectively functions as a document inlet or a document outlet. The first document path, responsive to the document fed in through the document-inlet, directs and drives the document from the document-inlet to the illumination/scan position, and, after the document is scanned, discharges the document to the multifunction opening. The second document path, responsive to the document fed in through the multifunction opening, directs and drives the document from the multifunction opening to the illumination/scan position, and, after the document is scanned, discharges the document to the document outlet. A section of the first document path and a section of the second document path overlaps to each other and defines an overlapping path.

4 Claims, 3 Drawing Sheets

IMAGE FORMING APPARATUS WITH MULTIFUNCTION OPENING

FIELD OF INVENTION

The present invention relates to an image forming apparatus and, more particularly, to an image forming apparatus which includes a multifunction opening selectively enabled as a document inlet or a document outlet.

BACKGROUND OF THE INVENTION

An Automatic document feeder (ADF) is extensively used within a copier or similar image forming apparatus, e.g. an image scanner, for sequentially feeding a plurality of documents (media) with image thereon to an illumination/scan position within an image forming apparatus. At the illumination/scan position, the document, e.g. a sheet of paper or transparency, is illuminated by a light source and scanned by an image sensor (CIS) in order to reproduce an image thereof. In general, the document fed by the automatic document feeder is driven along a curve document path within the image forming apparatus.

It is found, however, that, for a medium made of material other than paper, the result of image forming is not good due to factors of (1) the curve document path design, (2) the roller provided within the ADF exerting a higher friction on the medium such that the medium deforms to a substantial degree. This is specially true for medium of transparency type.

There is, therefore, an evident need of an image forming apparatus which includes a document path specially for the medium made of material other than paper.

SUMMARY OF THE INVENTION

It is, therefore, an object of the present invention to provide an image forming apparatus which is capable of driving the medium through either a curve document path or a flat document path.

To perform scanning of a medium of paper type, the medium is fed at the inlet of ADF provided in the invention, driven through a first document path in a first direction, and discharged at a multifunction opening. To perform scanning of a medium of type other than the paper, the medium is fed at the multifunction opening, driven through a second document path in a second direction. The first document path is a curve document path and the second document path is a flat document path.

In accordance with the present invention, the image forming apparatus has a document-inlet, a multifunction opening, a document-outlet, a first document path and a second document path. The multifunction opening selectively functions as a document inlet or a-document outlet.

The elements along the first document path, responsive to the document fed in through the document-inlet, directs and drives the document from the document-inlet to the illumination/scan position, and, after the document is scanned, discharges the document to the outside of multifunction opening.

The elements of second document path, responsive to the document fed in through the multifunction opening, directs and drives the document from the multifunction opening to the illumination/scan position, and, after the document is scanned, discharges the document to the outside of document outlet.

A section of the first document path and a section of the second document path overlaps to each other and defines an overlapping path. The illumination/scan position is located at one predetermined position along the overlapping path.

DESCRIPTION OF THE PREFERRED EMBODIMENT

Figure 1:
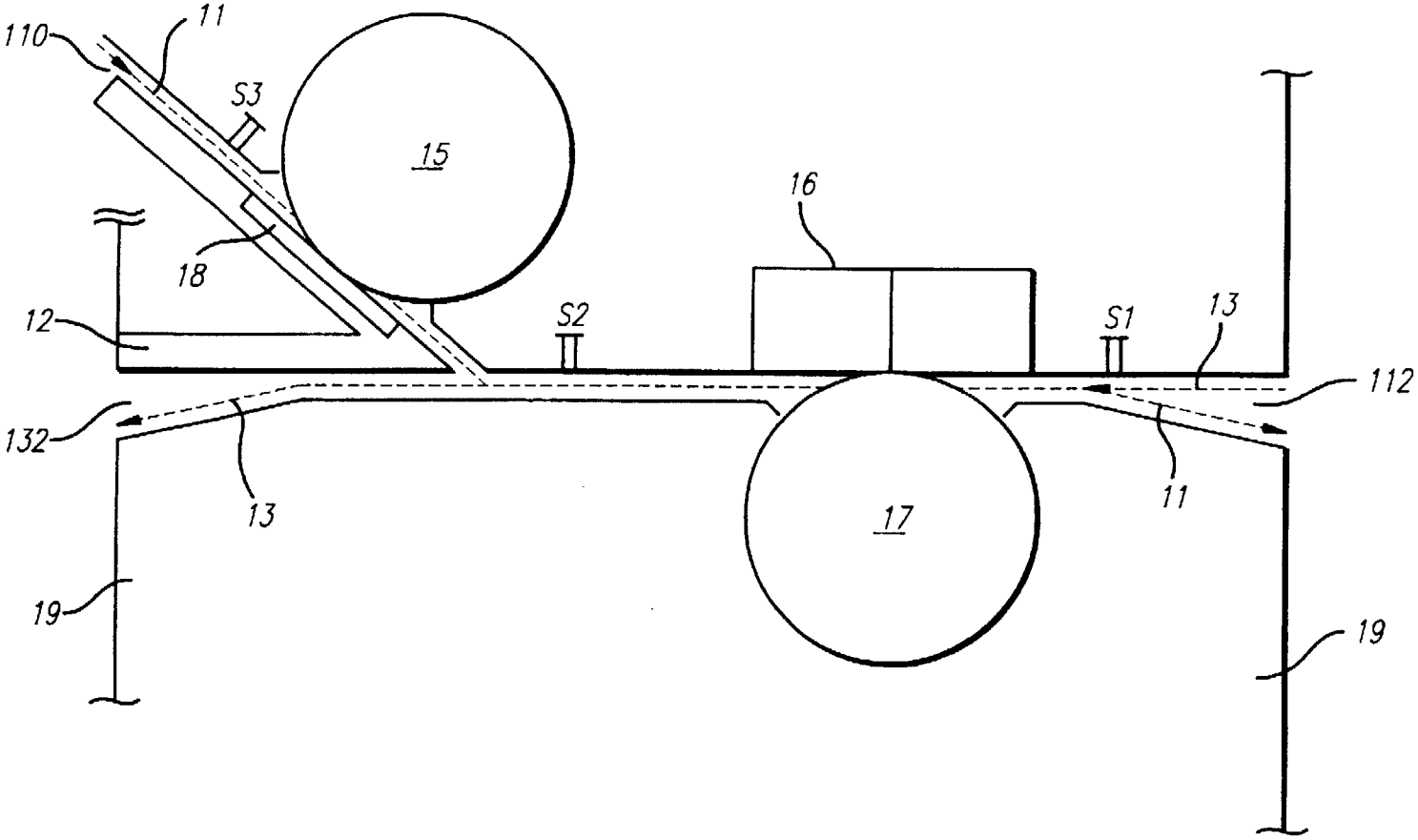
FIG. 1 shows the components of the invention.

As shown in FIG. 1, the present invention includes a first document path 11 along which an ADF pick-up roller 15, a guide 12, a bi-direction roller 17, sensors s3, s2, s1 and an image sensor 16, e.g. CIS. The s3, s2, s1 are sensors of touch-activate type. The entry of the first document path 11 defines the document-inlet 110 and a multifunction opening 112, the function of which will be more clear hereinafter, defines the exit of the first document path 11 when the first document path 11 is utilized. The sensor s3 functions to sense existence of a document on the location of document-inlet 110. As forward scanning, which directs the document from document-inlet 110 to multifunction opening 112, is desired, the operator inserts the document within the document-inlet 110. The sensor s2 functions to sense existence of a document between roller 15 and roller 17 along the first document path 11. In addition, during movement of the document along the first document path 11, the sensor s2 functions to inform the controller (not shown) the document has reached the location of sensor s2. The controller, based on this information, controls the action of roller 15 such that the document could reach the scan position below the image sensor 16 accurately. The sensor s1 functions to sense existence of a document on the location of multifunction opening 112. The document is directed through the first document path 11 indicated by the arrow sign in FIG. 1. During the forward operation, the roller 15 is driven counterclockwise and the roller 17 is driven clockwise concurrently. The surface of housing under the sensor s1 and proximate to the multifunction opening 112 presents a slope as shown which allows the document passing the scanning position 16 to slip out and prevents the forward scanning document from activating the sensor s1. The surface of housing proximate to the document-outlet 132 also presents a slope as shown which allows the reverse scanning document to slip out. Only the document fed into through the multifunction opening 112 and gripped by the roller 17 can activate the sensor s1. It is to be noted, while operating the preferred embodiment, the minimum document length for forward scanning must be greater than the path distance between the roller 15 and roller 17.

As the forward scanning operation begins, the topmost sheet of documents in the document-stack is fed into the inner space of ADF through the nip between the pick-up roller 15 and the cooperating guiding pad 18. Afterwards, the fed-in document moves along the first document path 11 and is loaded on the scanning position by the counterclockwise operation of the roller 15. During forward scanning operation, the document passes the nip between the bi-direction roller 17 and bottom surface of image sensor 16 and then is discharged to the outside of the housing 19 of the image forming apparatus. It is to be noted that, as the document moves along the first document path 11, the bi-direction roller 17 functions as a discharge roller which discharges the document to outside of the housing 19 through the multifunction opening 112.

Also shown in FIG. 1, the present invention includes a second document path 13 for reverse scanning operation which is defined by the guide 12, the bi-direction roller 17, sensor s2, sensor s1 and the image sensor 16. The reverse scanning operation directs the document from multifunction opening 112 to the document-outlet 132. The multifunction opening 112 defines the entry of second document path 13 and the document-outlet 132 defines the exit of the second document path 13. The sensor s1 functions to sense existence of a document on the location of multifunction opening 112 and informs the controller (not shown) that a document is ready to perform reverse scanning operation. The controller, based on this information, disables the action of roller 15 such that the document sensed by the sensor s3 will not be loaded into the first document path 11 preventing jamming of documents. The document is directed through the second document path 13 indicated by the arrow sign in FIG. 1. During reverse operation, the roller 17 is driven counterclockwise and the roller 15 is kept steady.

As the reverse scanning operation begins, the single sheet of document is fed into the nip between the bi-direction roller 17 and the bottom surface of the image sensor 16. During scanning operation of the document by the image sensor 16, the document passes the nip between the bi-direction roller 17 and bottom surface of image sensor 16 and then is discharged to the outside of housing 19 of the image forming apparatus along the second document path 13 shown. It is to be noted that, as the document moves along the second document path 13, the bi-direction roller 17 function as a pick-up roller first and, then, discharge roller which discharges the document to outside of the housing 19 through document-outlet 132.

It is observed that a section of the first document path 11 and a section of the second document path 13 overlaps to each other and defines an overlapping path.

In the illustrated example, the multifunction opening 112 functions as the document outlet as the user selects the first document path 11, and, as the user selects the second document path 13, the multifunction opening 112 functions as the document inlet. To share the same image sensor both for forward and reverse scanning operation, the illumination/scan position is located at one predetermined position along the overlapping path. The predetermined illumination/scan location is substantially below the image sensor device 16.

Figure 2:
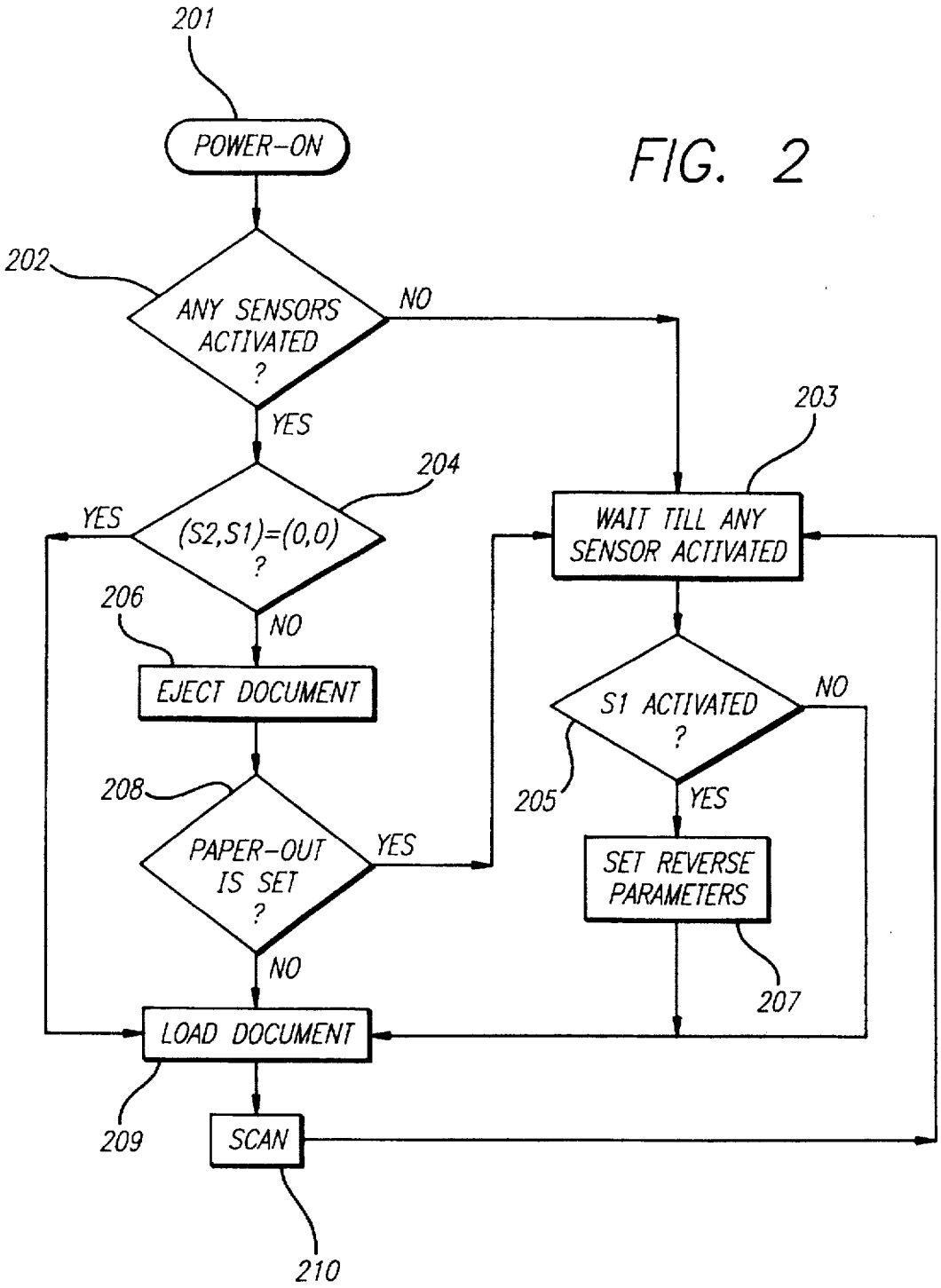
FIG. 2 shows the eject and/or load process of the invention.

Shown in FIG. 2 is the detailed process performed by the invention shown in FIG. 1. Block 201 is the power-on stage. In block 202, the process detects any sensors s1, s2 or s3 is activated. If, in block 202, any one of the sensors is detected, in block 204, the process decides whether both s2, s1 are not activated.

Figure 3:
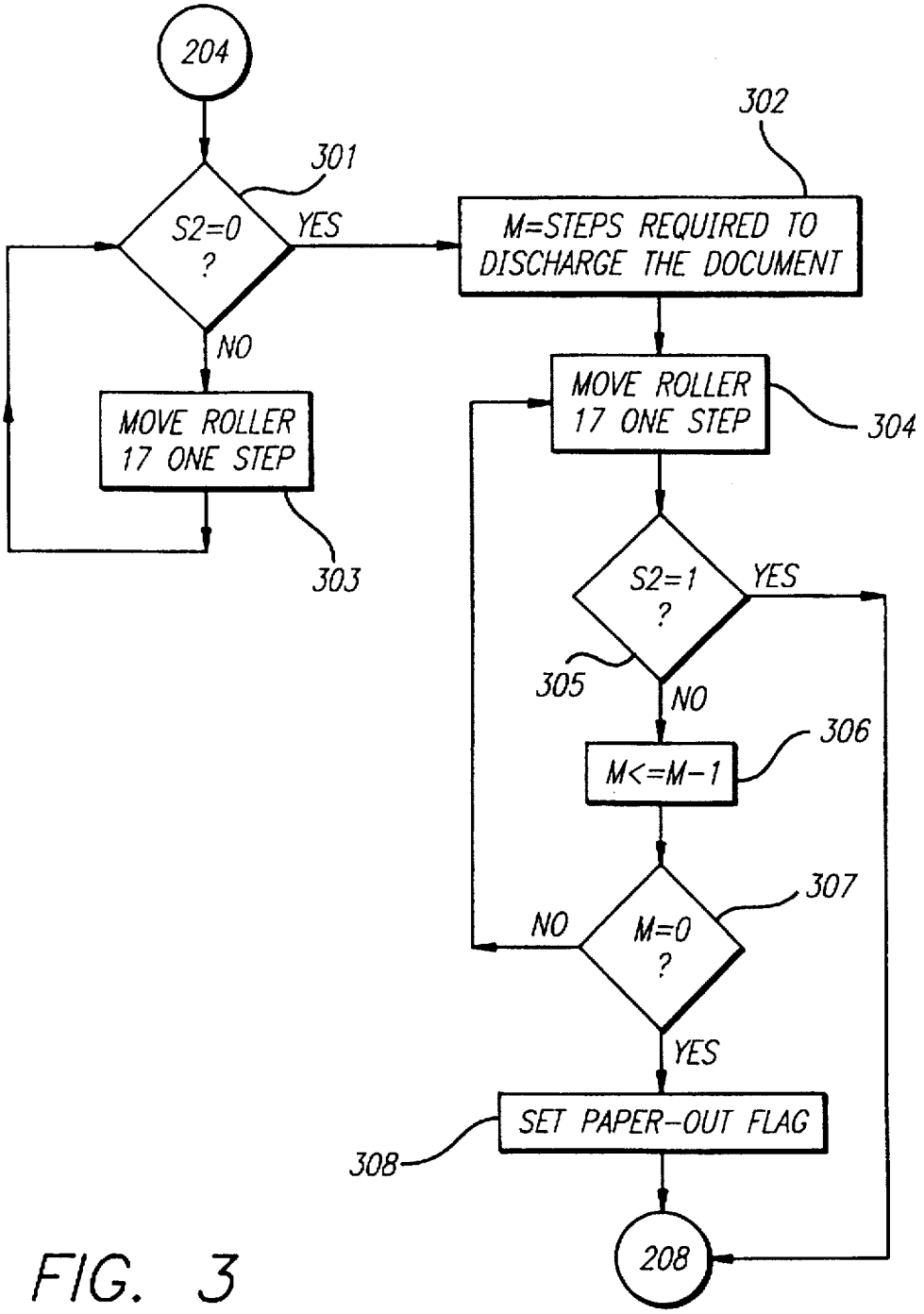
FIG. 3 shows the details of the eject process 206 in FIG. 2.

If it is yes in block 204, the process goes to the block 209 to load the document sensed by the s3. If it is no in block 204, the process, in block 206, ejects a document left in the document overlapping path during the last operation session. The details of the block 206 is shown in FIG. 3. Afterwards, in block 208, the process detects if a paper-out flag is set. The paper-out flag is set as a document is discharged without scanning which is more clear from recitations of FIG. 3. If it is no in block 208, the process goes to block 209 to load the document sensed by s3. If it is yes in block 208, the process goes to block 203, in which the process waits till any sensors are activated. When any sensor is activated in block 203, the process goes to block 205. Since the reverse scanning request has higher priority than the forward scanning request in this invention, in block 205, the process detects whether sensor s1 is activated.

If it is yes in block 205 representative of a document being fed through the multifunction opening 112, in block 207, the process sets the reverse parameters to drive the roller 17 counterclockwise and to halt the roller 15. Afterwards, the process goes to the block 209 to load the document sensed by s1. If it is no in block 205, the process directly goes to block 209 to drive the roller 17 clockwise and drive the roller 15 counterclockwise in order to load the document sensed by s3.

After completion of loading of document on the scanning position in block 209, the process goes to block 210 for scanning process. After completion of the scanning process, the procedure goes to block 203. In particulars, during the forward scanning of multiple documents in the ADF, the sensor s1 will not be activated by the documents discharged due to the slope design shown. And, at the end of forward scanning of last document in ADF, the procedure goes to the block 203.

The details of document eject process is disclosed in FIG. 3. The block 301 detects if sensor s2 is not activated. If it is no representative of a document existing along the overlapping path, the process goes to block 303 to drive roller 17 one step clockwise. The loop formed by block 301 and block 303 is repeatedly performed until s2 is not activated at which point the document still need to be driven a predetermined distance from s2 to nip of the roller 17. In other words, as s2 is not activated, the process goes to block 302 to set a predetermined value to the variable M. The predetermined value is number of step of the roller 17 needed to discharge the document at the multifunction opening 112. In block 304, the process moves the roller 17 one step clockwise. Since the roller 15 is driven concurrently with the roller 17 in the block 206, in block 305, the process detects if s2 is activated due to a next fed-in document reaching the sensor s2. If it is yes in block 305, the process goes to block 208 directly without setting the paper-out flag in block 308. It is to be noted that, during ejection of a document existing along the overlapping path and, at the same time, s2 is sensed to be active in block 305 due to a next fed-in document reaching the sensor s2, the document already in the path is discharged out of the housing 19 first without scanning and, then, the next fed-in document will be loaded by block 209 for further scanning operation in block 210. If it is no in block 305, in block 306, the variable M is decreased by 1. Afterwards, in block 307, the process detects if M reaches value of zero. If it is yes representing total number of steps needed to discharge the existing document has been completed, the process goes to block 308 to set the paper-out flag. If it is no in block 307, the operation within the loop, which consists of block 304, 305, 306, 307, is repeatedly performed.

We claim:

1. An image forming apparatus having an illumination/scan position for scanning an image on a document passing the illumination/scan position, said image forming apparatus comprising:

a document-inlet;

a multifunction opening which selectively functions as document inlet or document outlet;

a document-outlet, a first document path which, responsive to the document fed in through the document-inlet, directs the document from the document-inlet to the illumination/scan position and which, after being illuminated and scanned, discharges said document to the multifunction opening;

a second document path which, responsive to the document fed in through the multifunction opening, directs the document from the multifunction opening to the illumination/scan position and which, after being illuminated and scanned, discharges said document to the document outlet, wherein a section of the first document path and a section of the second document path overlap each other defining an overlapping path, and the illumination/scan position is located at one predetermined position along the overlapping path; and means for controlling the path along which the document moves in the apparatus, wherein the controlling means comprises, a first sensor for detecting existence of the document at the multifunction opening, a second sensor disposed along the overlapping path for detecting existence of the document at a distance away from the illumination/scan position, and a third sensor for detecting existence of the document at the document-inlet.

2. The apparatus of claim 1, further comprising a surface under the first sensor and proximate to the multifunction opening having a slope which allows the document passing the scanning position to slip out.

3. The apparatus of claim 1, further comprising a surface proximate to the document-outlet having a slope which allows the document passing the scanning position to slip out.

4. The apparatus of claim 1, further comprising a pick-up roller for feeding a second document sensed by the third sensor, wherein:

said means for controlling disables the action of the pick-up roller when the first sensor detects existence of a first document at the multifunction opening.

* * * * *